US006568159B2

(12) United States Patent
Kawai et al.

(10) Patent No.: US 6,568,159 B2
(45) Date of Patent: May 27, 2003

(54) STRAPPING PACKING MACHINE

(75) Inventors: Osatomi Kawai, Kanagawa (JP); Eiji Tobita, Kanagawa (JP); Seiichiro Koyama, Kanagawa (JP)

(73) Assignee: Strapack Corporation, Tokyo (JP)

( * ) Notice: Subject to any disclaimer, the term of this patent is extended or adjusted under 35 U.S.C. 154(b) by 0 days.

(21) Appl. No.: 09/894,932

(22) Filed: Jun. 28, 2001

(65) Prior Publication Data

US 2002/0000080 A1 Jan. 3, 2002

(30) Foreign Application Priority Data

Jun. 28, 2000 (JP) ..... 2000-194010
Dec. 6, 2000 (JP) ..... 2000-370972

(51) Int. Cl.[7] ..... B65B 13/04; B65B 13/06; B65B 13/25

(52) U.S. Cl. ..... 53/589; 100/25; 100/26; 100/29

(58) Field of Search ..... 53/589, 390, 582; 100/25, 29, 32, 26, 8, 1

(56) References Cited

U.S. PATENT DOCUMENTS 3,213,781 A * 10/1965 Collins et al. ..... 100/26
3,263,599 A * 8/1966 Dickens ..... 100/25
3,279,354 A * 10/1966 Dickens et al. ..... 100/26
3,899,963 A * 8/1975 Tremper ..... 100/25
4,569,186 A * 2/1986 Mori et al. ..... 100/29
4,625,500 A * 12/1986 Huber ..... 53/589
4,653,394 A * 3/1987 Kasuga et al. ..... 100/2
4,867,053 A * 9/1989 Kawai et al. ..... 100/26
5,083,412 A * 1/1992 Sakaki et al. ..... 100/2
5,355,786 A * 10/1994 Tipton et al. ..... 100/25
5,379,576 A * 1/1995 Koyama ..... 100/26
5,513,483 A * 5/1996 Tipton et al. ..... 100/26
5,916,108 A * 6/1999 Drietz et al. ..... 53/137.2
6,363,689 B1 * 4/2002 Rodriguez et al. ..... 100/2

* cited by examiner

*Primary Examiner*—Anthony D. Stashick
(74) *Attorney, Agent, or Firm*—Steinberg & Raskin, P.C.

(57) ABSTRACT

With a conventional baling machine, for tying an article resting on a pallet with a band, the article resting on the pallet is required to be placed in a frame of an arch guide. To solve this problem, the present invention provides a baling machine including a main body having a band feeding mechanism, a band bonding mechanism, and a band cutting mechanism; a vertical table (3) to be aligned with an article resting on a pallet; a band guide (7) provided to be drawn out from under the vertical table (3) in a horizontal direction; a support mechanism for supporting the band guide (7) inside the main body allowing it to slide; and wheels (17) provided to the main body, wherein the band guide (7) slides above the ground contact face of the wheels (17).

5 Claims, 13 Drawing Sheets

STRAPPING PACKING MACHINE

BACKGROUND OF THE INVENTION

1. Field of the Invention

This invention relates to a baling machine for tying an article with a band, more particularly, to a baling machine for tying an article resting on a pallet or like together with the pallet or the like by means of a band.

2. Description of Related Art

FIG. 19 is a diagram illustrating an article w resting on a pallet 50. The pallet 50 is composed of a top plate 51, a bottom plate 53 and vertical plates 52 connecting between the top plate 51 and the bottom plate 53. The article w resting on such a pallet 50 is tied together with the pallet by means of a band. FIG. 18 illustrates a conventional baling machine used in such a band-tying operation.

The conventional baling machine illustrated in FIG. 18 includes a main body 100 which is provided with a sealing unit 101 for tightening, bonding and cutting the band B, and a reel unit 102 for holding the band B.

On the sealing unit 101 and a base 104, an arch guide 103 is secured adjacent to the main body 100. The chain lines in FIG. 18 represent a lower guide 105 which is typically housed in the main body 100. The main body 100 includes a mechanism for moving the lower guide 105 in a horizontal direction from the main body 100 to the outside, and vice-versa.

In the band-tying operation, the lower guide 105 moves from an opening 106 toward the left in FIG. 18 to connect with a connecting port 107 of the arch guide 103. In order to make a proper connection between the lower guide 105 and the connecting port 107, the main body 100 and the arch guide 103 are fixed on the floor of a building.

When the conventional baling machine as explained above is used for tying the article w resting on the pallet 50 with the band B, the following steps are performed. First, an article w resting on a pallet 50 is placed on the base 104 in such a way that it is aligned with a side face of the sealing unit 101.

Then an operator pushes an operation button of the main body 100, whereupon the lower guide 105 moves leftward in FIG. 18 to pass through the space between the top plate 51 and the bottom plate 53 of the pallet 50 from the opening 106, and then connects with the arch guide 103.

Then, the band B unreeled from the reel unit 102 of the main body 100 reaches the arch guide 103 via the sealing unit 101, the lower guide 105, and the connecting port 107. The band B moves inside the arch guide 103 to return to the sealing unit 101. After the leading end of the band returns to the inside of the sealing unit 101, the sealing unit 101 tightens, bonds and cuts the band B. After that, the lower guide 105 moves into the main body 100 for housing. In this way, the article w is tied together with the pallet 50 by means of the band B.

The conventional baling machine designed as described above includes the arch guide 103. For this reason, when the article w resting on the pallet 50 is inserted in the frame of the arch guide 103 by using a forklift truck, the following problem arises.

When the article w resting on the pallet 50 is inserted in the frame of the arch guide 103, the pallet 50 is placed on the base 104. Hence, it is necessary to provide a conveyor on one or other side of the base 104. More specifically, due to a heavy weight of the article w on the pallet 50, it is necessary that the forklift truck is operated to place the article w resting on the pallet 50 first on the conveyor, then on the base 104. This produces a problem of a low workability.

Further, since the baling machine body 100 and the arch guide 103 are fixed on the floor of the building, it is necessary for a worker to convey the pallet 50 and the article w to their position in the frame of the arch guide 103.

SUMMARY OF THE INVENTION

It is an object of the present invention to provide a baling machine capable of facilitating the tying of an article resting on a pallet with a band.

As a first aspect, the present invention has the feature that a baling machine includes a main body including a band feeding mechanism, a band bonding mechanism, and a band cutting mechanism; a vertical table to be aligned with an article resting on a pallet; a band guide provided to be drawn out from under the vertical table in a horizontal direction; a support mechanism for supporting the band guide inside the main body and allowing the band guide to slide; and wheels provided to the main body, in which the band guide slides above the ground contact face of the wheels.

According to the first aspect, the provision of the wheels to the main body enables the main body to be moved to the site of the article resting on the pallet or the like and the vertical table on the main body to be aligned with the article. As long as the vertical table on the main body is aligned with the article, the band guide can be inserted under the pallet or the like, so that the band guided by the band guide can be passed under the pallet or the like. Consequently, it is possible to pass the band under the pallet or the like without moving the article resting on the pallet.

As a second aspect, the present invention has the feature that the band guide is supported only by the support mechanism provided in the main body.

According to the second aspect, since the band guide is supported only by the support mechanism provided in the main body, the band guide is supported while being drawn out from the main body.

As a third aspect, the present invention has the feature that the support mechanism includes a retainer member for inhibiting the turning of a leading end of the band guide toward the ground contact of the wheels.

According to the third aspect, even when the band guide is drawn out from the main body, there is no chance of the leading end of the band guide making a downward inclination.

As a fourth aspect, the present invention has the feature that the support mechanism includes a stop mechanism for determining a selected position for drawing out the band guide.

According to the fourth aspect, since the band guide can be stopped at a selected position, the extent of drawing out the band guide can be determined in correspondence with the size of the pallet or the like.

As a fifth aspect, the present invention has a feature that the main body further includes a band tightening mechanism including an input member linked to an output shaft of a motor serving as a power source, an output member linked to a tension roller for pulling the band, and a powder clutch for engaging or disengaging the input member with or from the output member, and torque transferred from the input member to the output member is varied in accordance with excitation current applied to the powder clutch.

According to the fifth aspect, the band tightening mechanism includes the powder clutch. With such band tightening mechanism, a strength of the fixation between the rotor and the shaft can be changed in accordance with a magnitude of the excitation current passing through the coil of the powder clutch, to vary torque transferred from the rotor to the shaft. Since the torque transferred from the rotor to the shaft is thus varied, it is possible to control a force of tightening the band.

DETAILED DESCRIPTION OF THE PREFERRED EMBODIMENTS

Figure 1:
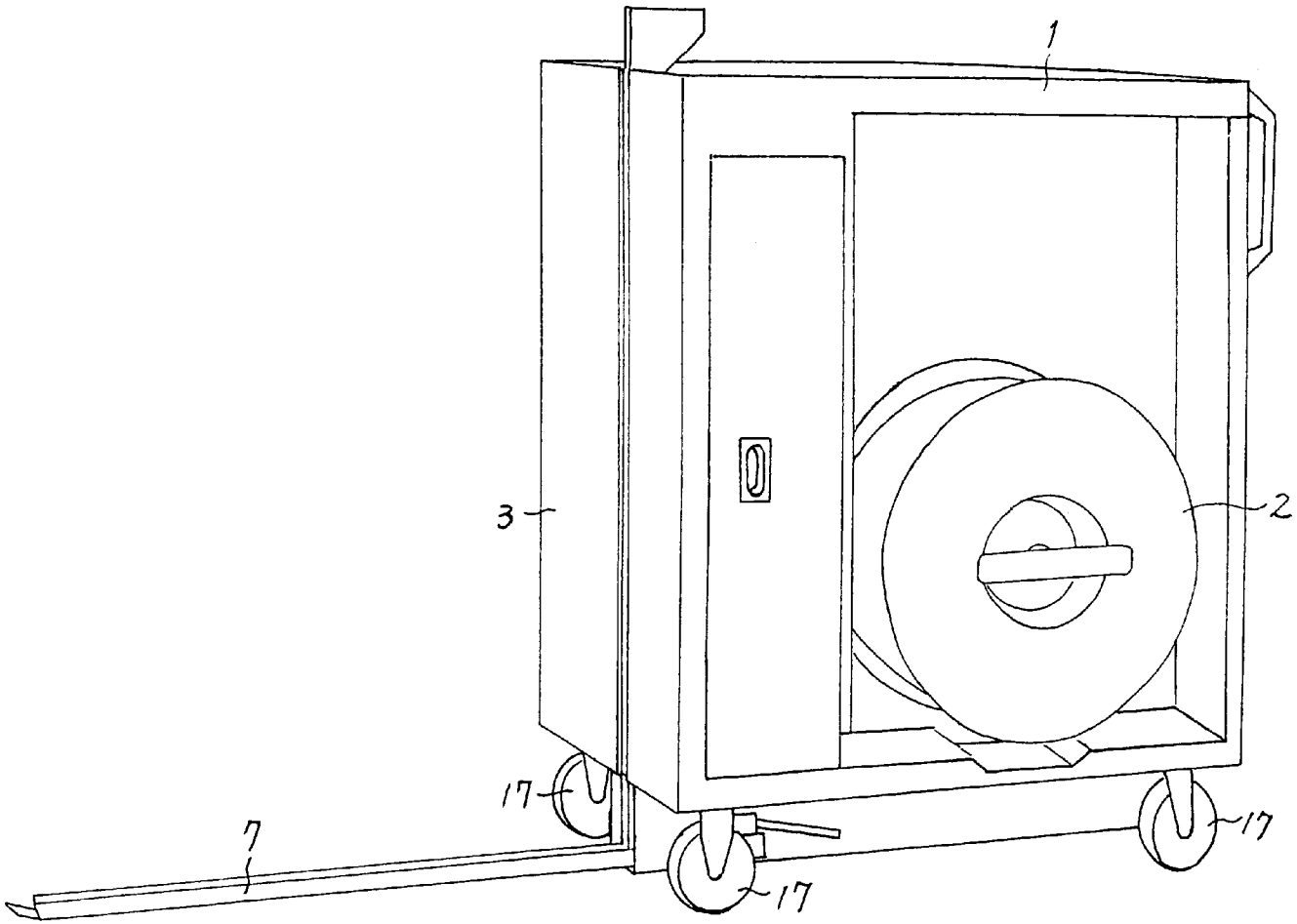
FIG. 1 is an external perspective view of a baling machine according to the present invention.

FIG. 1 is a perspective view illustrating a first embodiment according to the present invention. A main body 1 holds a reel unit 2 allowing it to rotate and has a side face serving as a vertical table 3.

Figure 2:
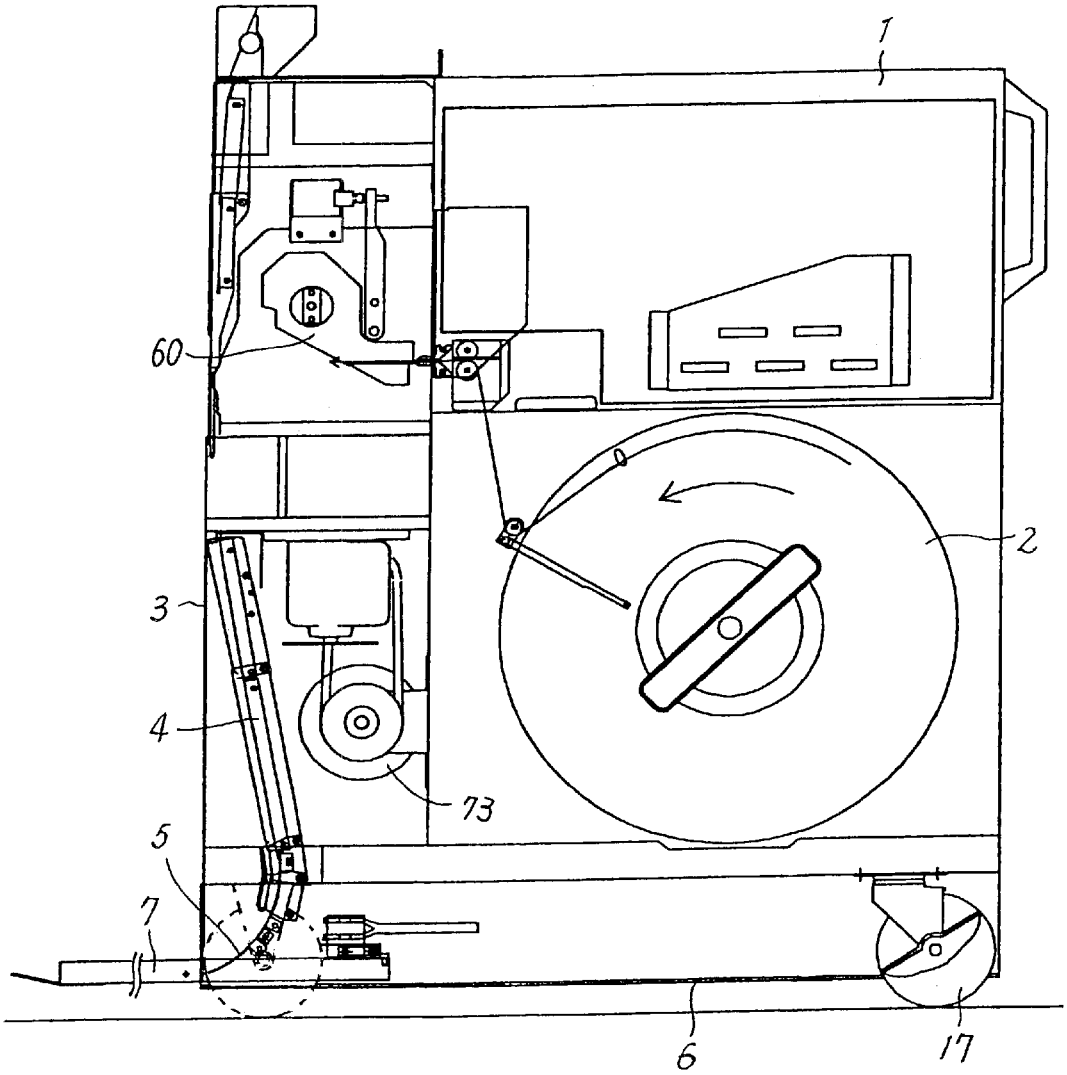
FIG. 2 is a side view of the baling machine.

Inside the vertical table 3, a band feeding mechanism, a band tightening mechanism, a band bonding mechanism and a band cutting mechanism are incorporated. FIG. 2 is a side view illustrating the first embodiment. Reference numeral 60 represents the band tightening mechanism.

The above individual mechanisms in the first embodiment are arranged along the vertical table 3, whereas the corresponding mechanisms in the conventional baling machines are arranged along a horizontal table.

The band tightening mechanism 60 will be described later. The band bonding mechanism and the band cutting mechanism are the same as those used in the prior art and the description is omitted.

As illustrated in FIG. 2, a band B having passed through all the above mechanisms is guided by a stationary guide 4 and an arcuate guide 5 continuing from the stationary guide 4 to reach the bottom portion of the main body 1.

Figure 3:
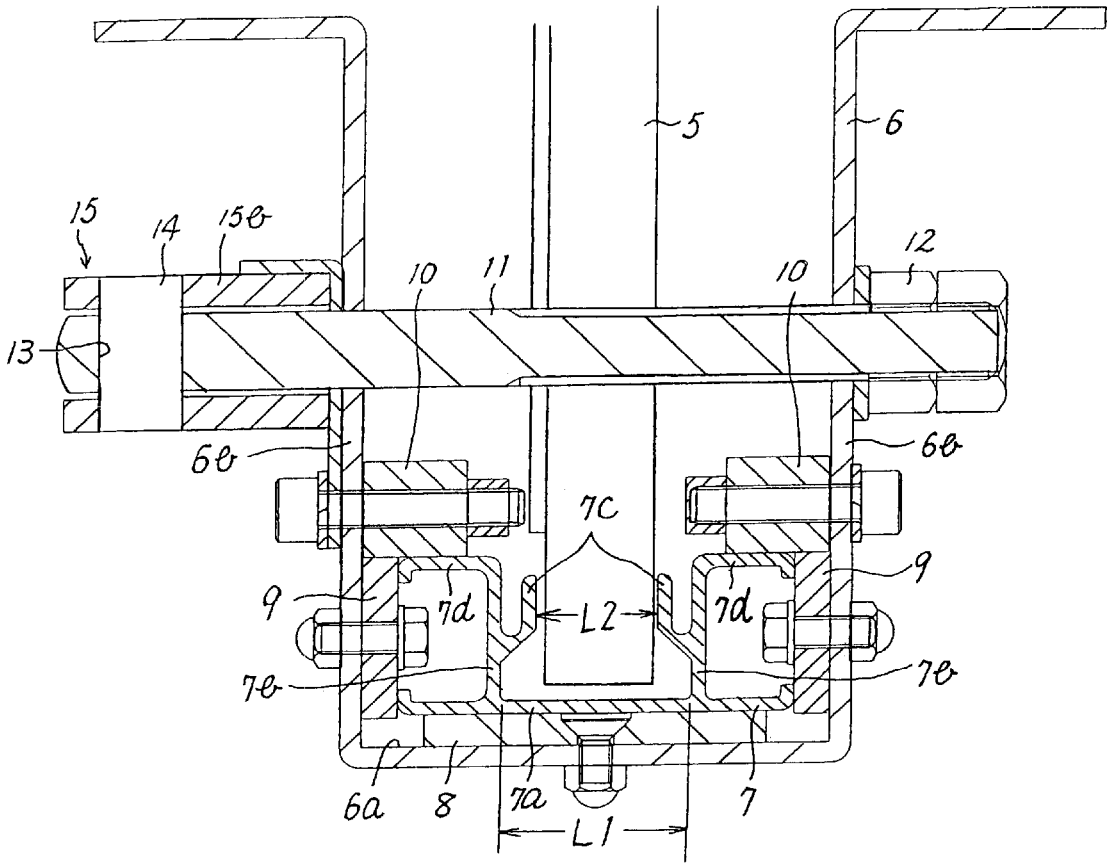
FIG. 3 is a sectional view of a band guide.
Figure 4:
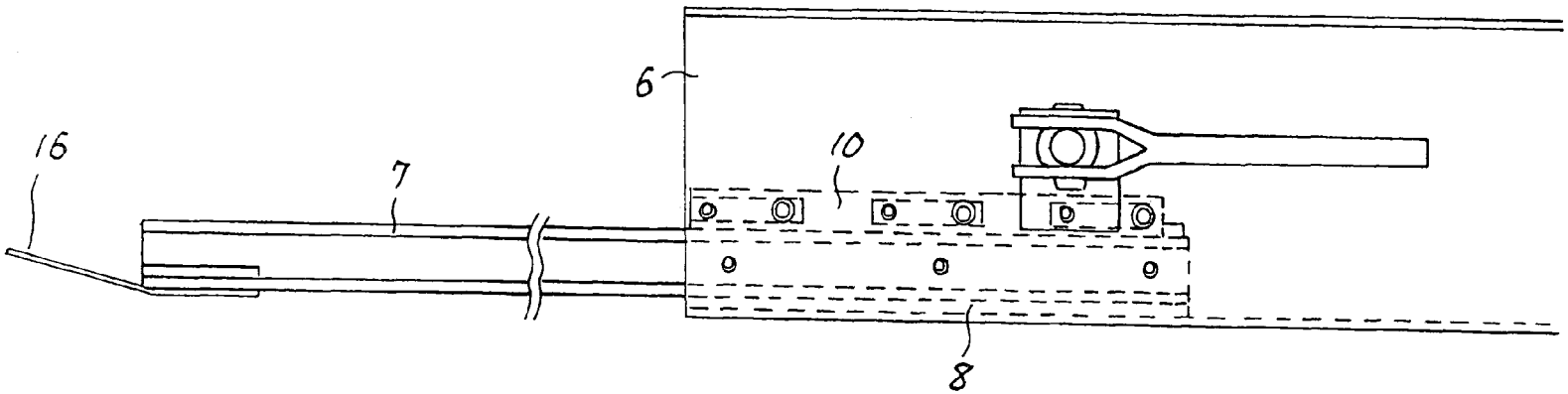
FIG. 4 is a side view of the band guide.

On the bottom portion of the main body 1, a recess-shaped holder 6 is provided. The holder 6 has a bottom face 6*a* and two side walls 6*b* provided along either side of the bottom face 6*a*. In the holder 6, a band guide 7 is provided moving in a horizontal direction, of which the sectional form is illustrated in FIG. 3.

Specifically, the band guide 7 has a bottom plate 7*a* on which a pair of guide pieces 7*b* are provided in an upright position at a predetermined interval. From the opposite faces of the guide pieces 7*b*, introductory guide pieces 7*c* protrude on either side. From each of the top ends of the guide pieces 7*b*, a horizontal piece 7*d* protrudes outward.

The above bottom plate 7*a*, guide piece 7*b*, introductory guide piece 7*c* and horizontal piece 7*d* continue in the longitudinal direction of the band guide 7.

The band guide 7 designed as described above is supported by a support mechanism provided in the main body 1. As illustrated in FIG. 3, the support mechanism is composed of a bottom-plate support member 8, a side-face support member 9 and a retainer member 10 which is a feature of the present invention, all of which are arranged so as to surround the band guide 7 and allow it to slide. Specifically, the bottom plate 7*a* of the band guide 7 is placed so as to slide on the bottom-plate support member 8. Each of the side portions of the bottom plate 7*a* and the horizontal piece 7*d* in the width direction is retained by the side-face support member 9 to prevent rolling. Additionally, the horizontal piece 7*d* is retained by the retainer member 10 so as not to move upward.

Accordingly, the band guide 7 is supported by the support mechanism so as to slide while being prevented from rattling. However, the band guide 7 is not completely prevented from rattling, but is prevented from rattling to the extent of interfering with the operation of the band guide 7.

Due to the sliding facility provided to the band guide 7 by the support mechanism, the band guide 7 can be drawn out outward from the main body 1 as illustrated in FIG. 1. Even while the band guide 7 is thus being drawn out, the band guide 7 is supported by the support mechanism so that its leading end does not touch the ground.

A stop mechanism S is provided for determining the point to which the band guide 7 is drawn out. As illustrated in FIG. 3, the stop mechanism S has a rod 11 as a principal element which passes through the side walls 6*b* of the aforementioned holder 6. Specifically, the rod 11 has one penetrating-end on which a nut 12 is secured and the other penetrating-end on which a hole 13 is provided. The hole 13 is provided with a shaft 14 on which an operation member 15 is rotatably mounted.

Figure 5:
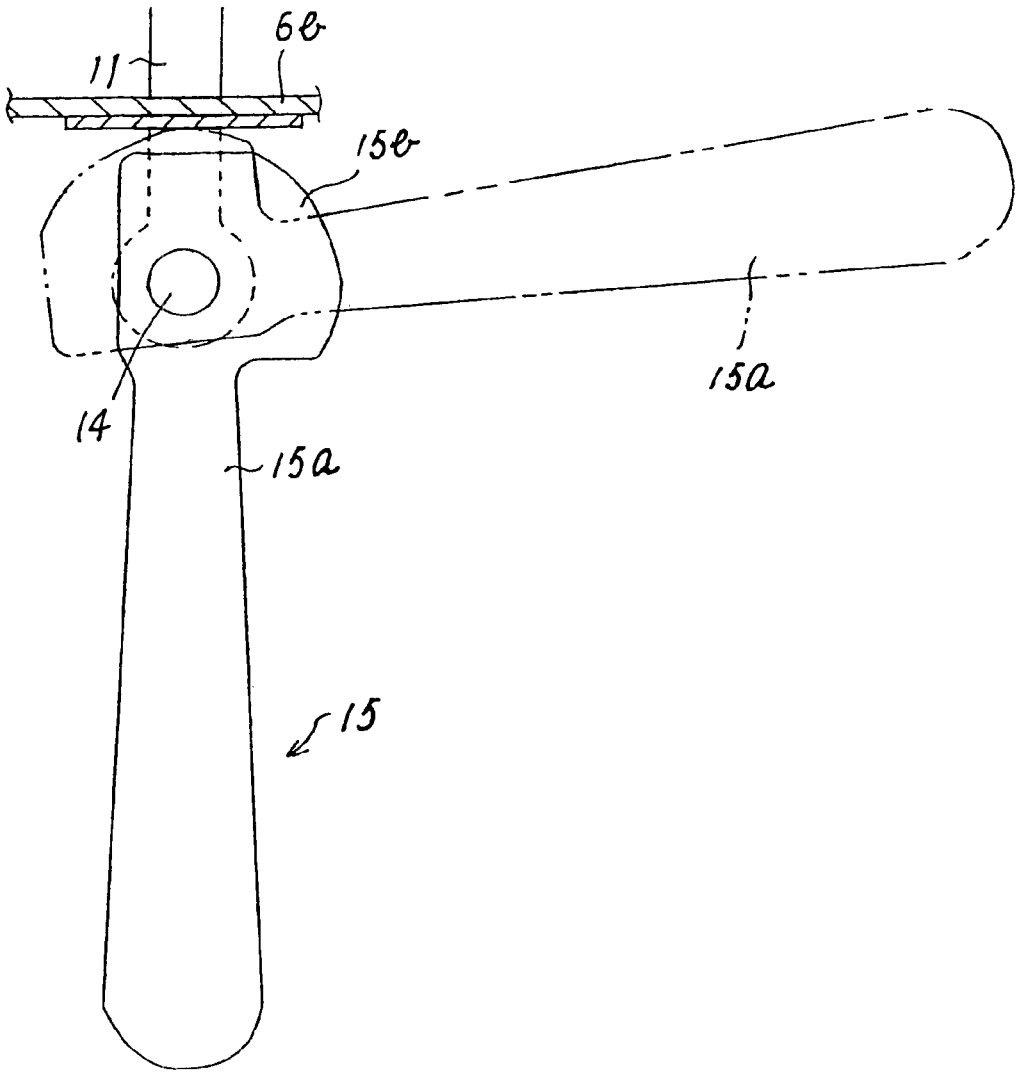
FIG. 5 is a top view of a clamp lever.

As illustrated in FIG. 5, the operation member 15 has a lever 15*a* and a cam 15*b* provided at an end of the lever 15*a*. The rotation of the cam 15*b* allows the operation member 15 to come into contact with one of the side walls 6*b* or move away therefrom.

When the operation member 15 is situated at the position indicated by the solid line in FIG. 5, the cam 15*b* is separated from the side wall 6*b*. Then when the lever 15*a* is turned to hold the operation member 15 in the position indicated by the chain line in FIG. 5, the cam 15*b* comes into contact with one of the side walls 6*b* and presses it, and the reaction force of the pressing force pulls the rod 11. The force pulling the rod 11 in turn draws the other side wall 6*b*.

In other words, when the operation member 15 is held in the position indicated by the solid line in FIG. 5, the space between the pair of opposite side walls 6*b* is maintained in its normal state. However, when the operation member 15 is held in the position of the chain line, the space between the pair of opposite side walls 6*b* is decreased.

When the space between a pair of opposite side walls 6*b* is decreased, the band guide 7 is clamped to the extent of the decreased space by the side-face support members 9, and is stopped at a predetermined position by the clamping force of the side-face support members 9.

With respect to a space L1 between the guide pieces 7*b* on the bottom plate 7*a* of the band guide 7, a space L2 between the introductory guide pieces 7*c* is sufficiently small. The space L2 is slightly larger than the width of the band B and the aforementioned arcuate guide 5 is inserted into the space L2.

Accordingly, the band B guided along the arcuate guide 5 is guided into the space between the introductory guide pieces 7*c* and then the space between guide pieces 7*b*. The band B thus guided into the space between the guide pieces 7*b* is retained by the introductory guide pieces 7*c* between which the space is smaller than that between the guide pieces 7*b*. Hence, the band B does not move upward from the band guide 7.

Even when the band guide 7 is drawn out to the maximum from the main body 1 as illustrated in FIG. 1, the band guide 7 has a part, e.g. one-fifth to one-sixth of its length, supported by the support mechanism provided in the main body 1. Further, when the band guide 7 is drawn out to the maximum as described above, each retainer member 10 is in contact with the corresponding horizontal piece 7*d* and retains it.

In the leading end of the band guide 7, a directing piece 16 is provided and has a leading end which slops upward for conducting the band B, drawn from the band guide 7, upward.

The main body 1 thus incorporating the band guide 7 as described above is provided with four wheels 17 for moving the main body 1. The support mechanism supports the band guide 7 in a position above the ground contact face of the wheels 17. In other words, when the band guide 7 is drawn out, the band guide 7 is positioned above the ground or the floor. More specifically, the band guide 7 drawn out from the main body 1 is designed to maintain a position at which the band guide 7 is inserted between the bottom plate 53 and the top plate 51 of the pallet 50. All of the dimensions and others of the pallet are defined by Japanese Industrial Standards, so that the position of the band guide is determined in correspondence with the defined dimensions.

Next, the operation in the first embodiment will be explained.

First, the band guide 7 is drawn out to the maximum from the main body 1 by hand and the stop mechanism S is operated for positioning the band guide 7. Then, the main body 1 provided with the wheels 17 is moved to a site of an article w resting on a pallet 50, and the vertical table 3 on the main body 1 is aligned with the article w. In this event, the band guide 7 is inserted into the space between a bottom plate 53 and a top plate 51 of the pallet 50.

At this point, the band feeding mechanism provided in the main body 1 is operated to draw a band B from the reel unit 2. The band B having been drawn from the reel unit 2 is guided via the stationary guide 4 and the arcuate guide 5 into the band guide 7. The band B thus guided into the band guide 7 passes through the band guide 7, then through the inside of the pallet 50, and is then guided by the directing piece 16 to be pushed out upward to the length required for tying.

As described above, since the band B is pushed out upward by the directing piece 16, a following band overlies the preceding band. Hence, the band is prevented from being tangled.

After the band B is thus guided from the band guide 7, the leading end of the band B is pinched for the band B to wind around the article w, and is then inserted into the band bonding mechanism.

After the leading end of the band B is thus inserted into the band bonding mechanism, the band tightening mechanism 60 tightens the band B. After that, the bonding and the cutting processes are performed in the conventional baling machine manner.

As described above, the main body 1 includes the wheels 17. Hence, it is possible to move the main body 1 to the site of the article w resting on the pallet 50 for tying them with the band. In other words, to tie the article w with the band, the main body 1 can be brought close to the article w resting on the pallet 50 in a fixed place on the floor.

Further, after the main body 1 is moved to the site where the article w resting on the pallet 50 is placed as explained above, the vertical table 3 on the main body 1 is aligned with the article w. When the vertical table 3 on the main body 1 is aligned with the article w, there is no need for the complicated operation of a forklift truck, resulting in improvement in workability.

Figure 6:
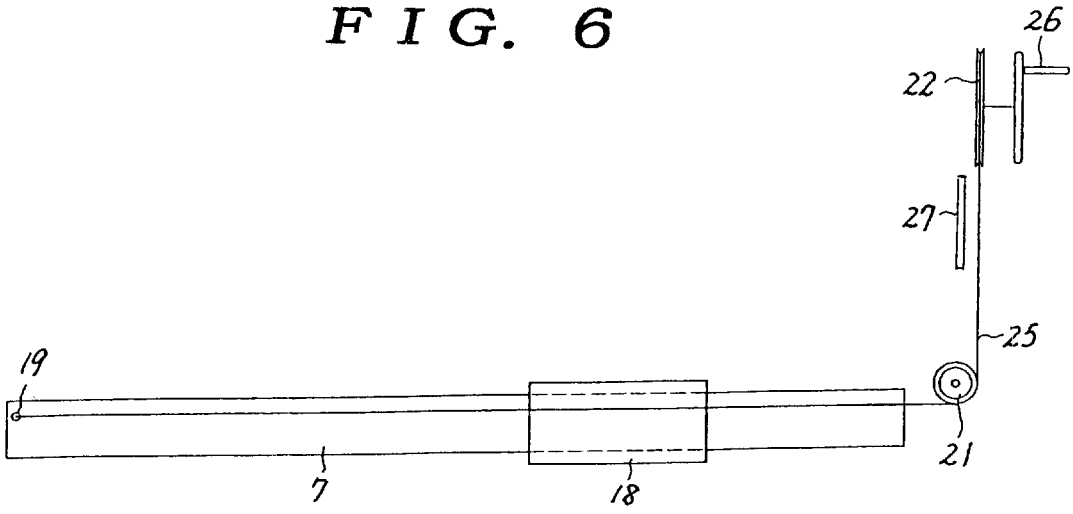
FIG. 6 is a side view of a band-guide moving mechanism according to a second embodiment.
Figure 7:
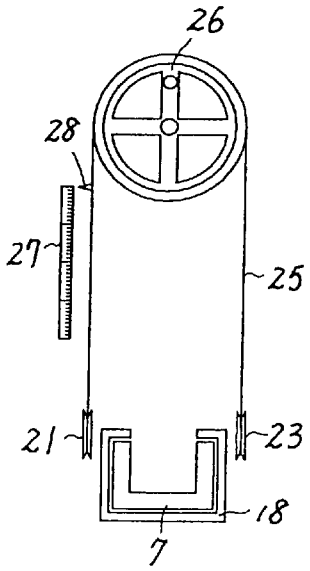
FIG. 7 is a back view of the band-guide moving mechanism according to the second embodiment.
Figure 8:
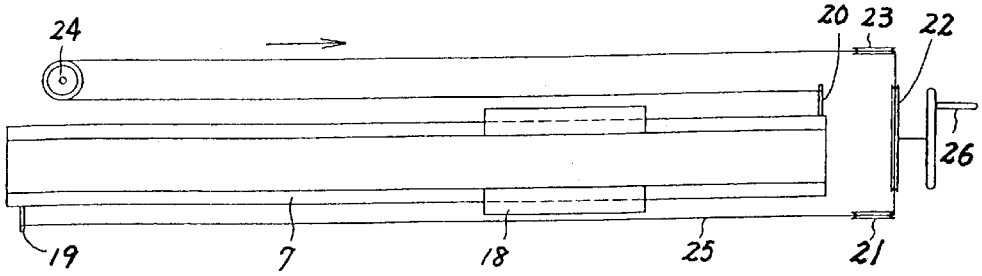
FIG. 8 is a top view of the band-guide moving mechanism according to the second embodiment.

In a second embodiment as illustrated in FIGS. 6 to 8, a pulley is used to move the band guide 7 into and out of the main body 1. Specifically, a guide member 18 which is the support mechanism holds the band guide 7 allowing it to slide, and pins 19, 20 are respectively provided on the opposite sides at the back and front ends of the band guide 7. A wire 25 is extended between the pins 19 and 20 via a plurality of pulleys 21 to 24.

The wire 25 is extended from the pin 19, which is provided at the leading end of the band guide 7, to the first pulley 21 provided at the rear of the band guide 7, and then is changed in direction at the first pulley 21 so as to be guided upward to wind onto the driving pulley 22. Then, the wire 25 having wound onto the driving pulley 22 is guided downward and changed in direction at the second pulley 23, and then guided to the third pulley 24 provided toward the leading end of the band guide 7 to wind onto the third pulley 24. Then, the wire 25 is turned around at the third pulley 24 so that the other end of the wire 25 is locked at the pin 20.

A handle 26 is provided to the driving pulley 22 and is turned by hand to rotate the driving pulley 22.

In FIGS. 6 and 7, a scale 27 is provided for measuring the amount of movement of an indicator 28 which is secured on the wire 25, namely the amount of travel of the band guide 7.

In the event illustrated in FIG. 8, the handle 26 is turned to rotate the driving pulley 22 to pull the wire 25 in the direction indicated by the arrow in FIG. 8, whereupon the band guide 7 is drawn out forward. On the other hand, when the handle 26 is turned in the opposite direction to the above, the band guide 7 is retracted. The amount of travel of the band guide 7 can be measured by the amount of relative movement of the indicator 28 to the scale 27.

Figure 9:
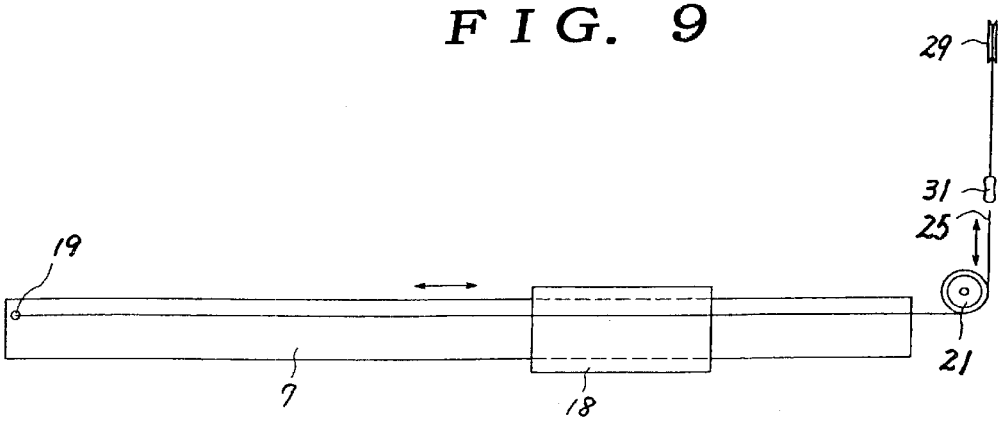
FIG. 9 is a side view of a band-guide moving mechanism according to a third embodiment.
Figure 10:
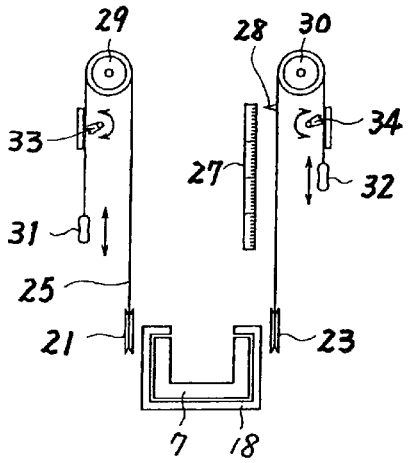
FIG. 10 is a back view of the band-guide moving mechanism according to the third embodiment.

A third embodiment illustrated in FIGS. 9 and 10 employs a traction mechanism instead of the handle 26 employed in the second embodiment, and the remaining configuration is similar to that in the second embodiment.

In the following description, the components equivalent to those in the second embodiment are designated by the same reference numerals.

Pulleys 29, 30 are respectively provided above a first pulley 21 and a second pulley 23. Wires 25 respectively turn in a downward direction at the pulleys 29, 30 and grips 31, 32 are respectively suspended at the leading ends of the wires 25. One-way clutches 33, 34 are respectively provided between the grips 31, 32 and the pulleys 29, 30. Upon pulling and then releasing the grips 31, 32, the one-way clutches 33, 34 work to maintain the pulling position. When the one-way clutches 33, 34 are disengaged, the wires 25 can move back in the opposite direction.

Hence, when one of the grips 31 and 32 is pulled, the band guide 7 moves in proportion to the amount of pulling of the grip 31 or 32.

Figure 11:
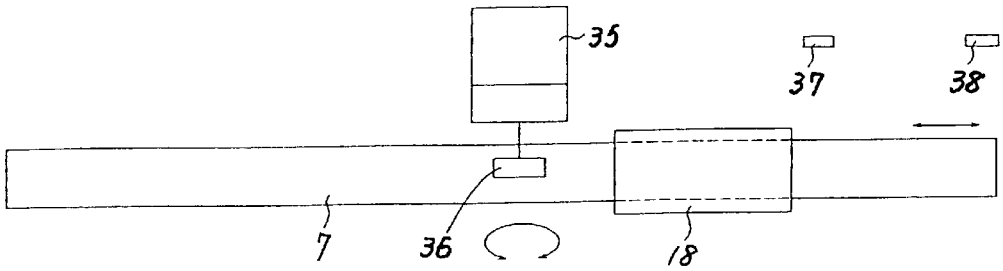
FIG. 11 is a side view of a band-guide moving mechanism according to a fourth embodiment.

A fourth embodiment illustrated in FIG. 11 is similar to the second and third embodiments in that the guide member 18 supports the band guide 7 allowing it to move.

The fourth embodiment differs, however, in that the band guide 7 is moved by a rotor 36 which has a large frictional force and is provided in an electric motor 35. Further, the fourth embodiment includes sensors 37, 38 for detecting the amount of travel of the band guide 7.

Figure 12:
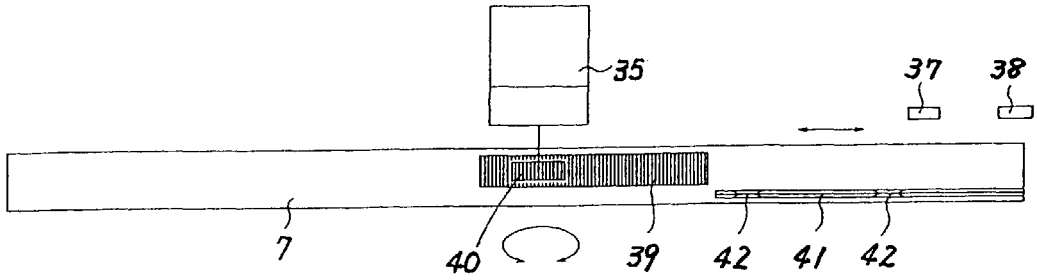
FIG. 12 is a side view of a band-guide moving mechanism according to a fifth embodiment.
Figure 13:
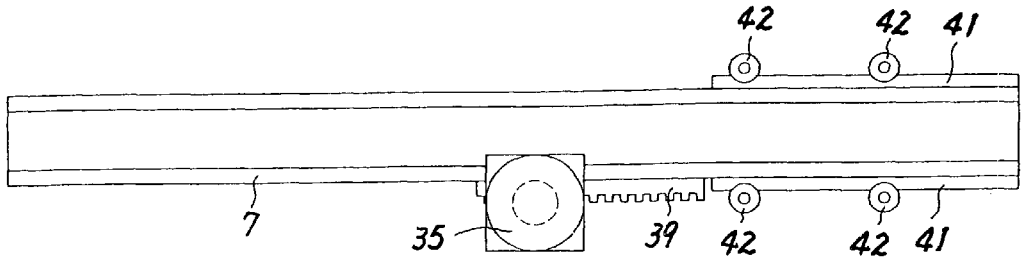
FIG. 13 is a top view of the band-guide moving mechanism according to the fifth embodiment.

A fifth embodiment illustrated in FIGS. 12 and 13 employs a rack-and-pinion mechanism instead of the rotor 36 in the fourth embodiment. A rack 39 is provided on a side face of the band guide 7 and a pinion 40 is provided on the rotating shaft of the electric motor 35.

In the fifth embodiment, a rail 41 is provided on a side face of the band guide 7 and engages with wheels 42 provided in the main body 1. Such rail 41 and wheels 42 constitute the support mechanism of the present invention.

The remaining configuration is similar to that of the fourth embodiment.

Figure 14:
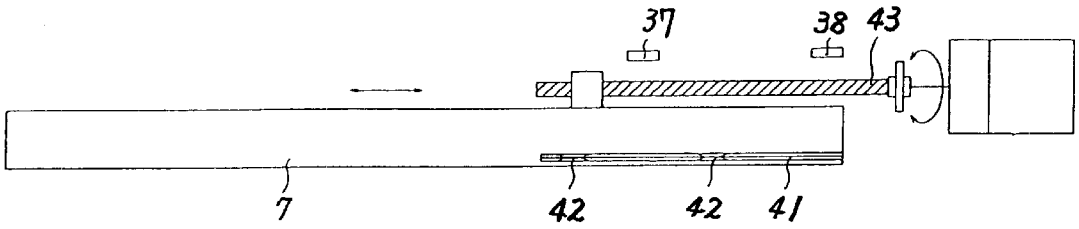
FIG. 14 is a side view of a band-guide moving mechanism according to a sixth embodiment.

A sixth embodiment illustrated in FIG. 14 employs a screw shaft 43 instead of the rack-and-pinion mechanism of the fifth embodiment.

Figure 15:
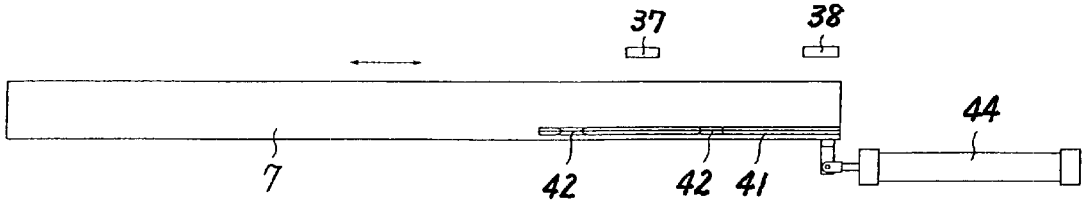
FIG. 15 is a side view of a band-guide moving mechanism according to a seventh embodiment.

A seventh embodiment illustrated in FIG. 15 employs a hydraulic cylinder 44 instead of the screw shaft 43.

Figure 16:
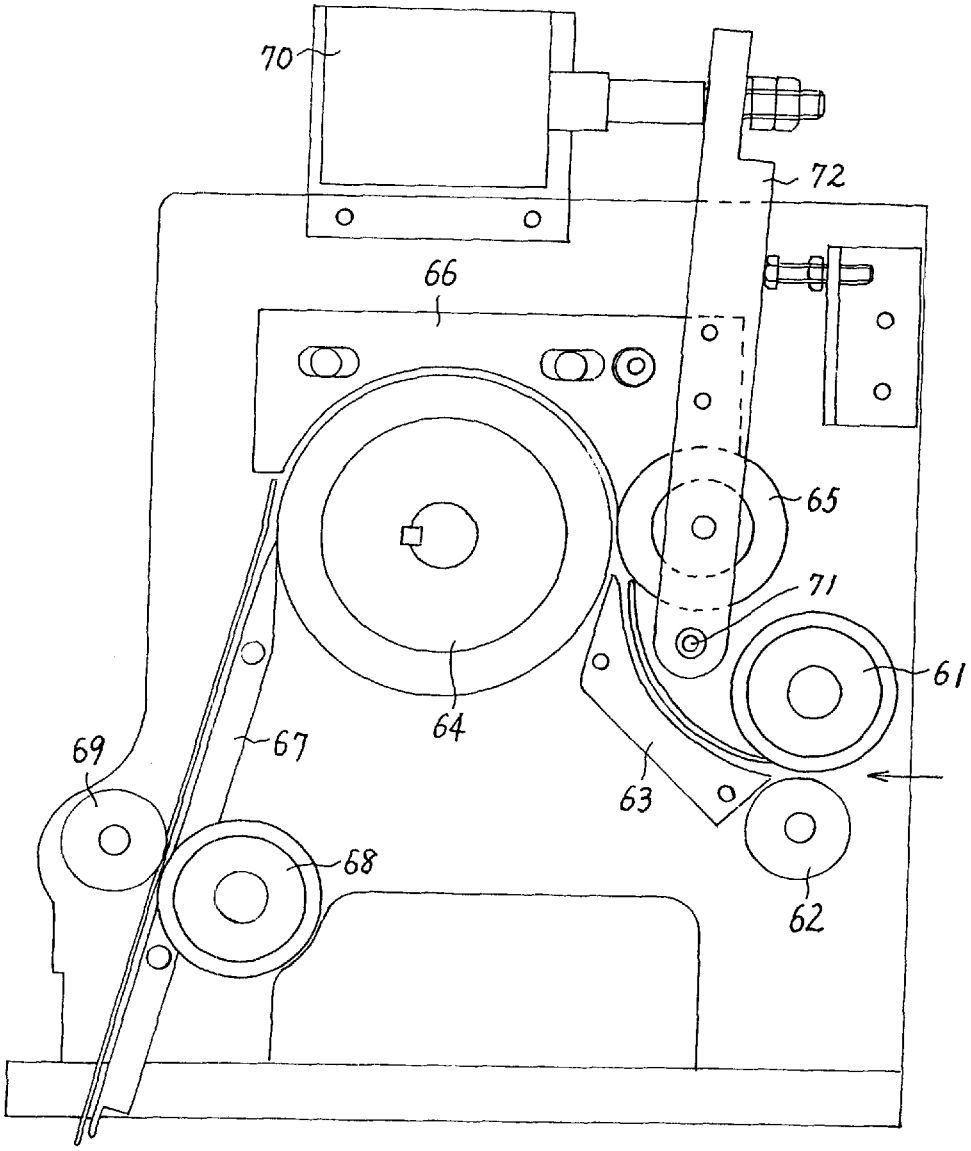
FIG. 16 is a diagram illustrating a structure of a band tightening mechanism.

FIG. 16 illustrates the specific structure of the band tightening mechanism 60 in FIG. 2.

From the position indicated by the arrow in FIG. 16, a band B fed from the reel unit 2 is inserted between a feed roller 61 and an auxiliary roller 62. Upon the entrance of the leading end of the band B between the feed roller 61 and the auxiliary roller 62, a solenoid (not shown) is triggered to move the auxiliary roller 62 toward the feed roller 61. The auxiliary roller 62 is moved toward the feed roller 61 to hold the band B between them, after which the feed roller 61 rotates. The rotation of the feed roller 61 carries the band B, inserted between the feed roller 61 and the auxiliary roller 62, toward a curve guide 63.

The band B having been carried by the feed roller 61 so as to pass along the curve guide 63 is inserted between a tension roller 64 and an auxiliary tension roller 65 which are provided to give a strong tightening process. The band B is further inserted between the tension roller 64 and a tension plate 66.

Subsequently, the band B having passed between the tension roller 64 and the tension plate 66 as sent by the feed roller 61, is directed along the linear guide 67. The band B then passes between a return roller 68 and an auxiliary roller 69 which are provided at the midpoint in the linear guide 67. The return roller 68 is provided for rewinding the band, as will be described later.

The band B having passed between the return roller 68 and the auxiliary roller 69 is sent along the vertical table 3 and is inserted into the band retainer mechanism (not shown). The band B having passed through the band retainer mechanism reaches the aforementioned stationary guide 4. As described in the first embodiment, the band B having passed through the stationary guide 4 is sent to the band guide 7. The band B is extended from the leading end of the band guide 7 to the length required for tying, after which the rotation of the feed roller 61 is stopped.

After the band is sent in this way, as described in the operation of the first embodiment, the operator puts the band B over the article w and then inserts the leading end of the band B into the band bonding mechanism, whereupon a sensor on a band stopper (not shown) is turned on.

Upon the turning on of the sensor of the band stopper, the auxiliary roller 69 moves toward the return roller 68. The auxiliary roller 69 and the return roller 68 then catch the band B between them, and then the return roller 68 rotates. The rotation of the return roller 68 moves the band B back to the reel unit 2 to the extent of the excess length of the band B put over the article w. When the band B put over the article w comes into tight contact with the surface of the article w, the rotation of the return roller 68 is stopped.

Next, a tension solenoid 70 is activated to pivot an auxiliary roller arm 72 about an axis pin 71 in the counterclockwise direction in FIG. 16. Upon the pivoting of the auxiliary roller arm 72, the auxiliary tension roller 65 moves toward the tension roller 64 to press the band B firmly against the tension roller 64. At this point, the rotation of an output shaft of a motor 73 serving as the power source is transferred to the tension roller 64 to rotate it in the counterclockwise direction in FIG. 16. The rotation of the tension roller 64 firmly tightens the band B, which is held between the tension roller 64 and the auxiliary tension roller 65, toward the reel unit 2.

The rotation of the output shaft of the motor 73 is transferred through a powder clutch 74 to the tension roller 64. The following is a description of the configuration of the powder clutch 74.

Figure 17:
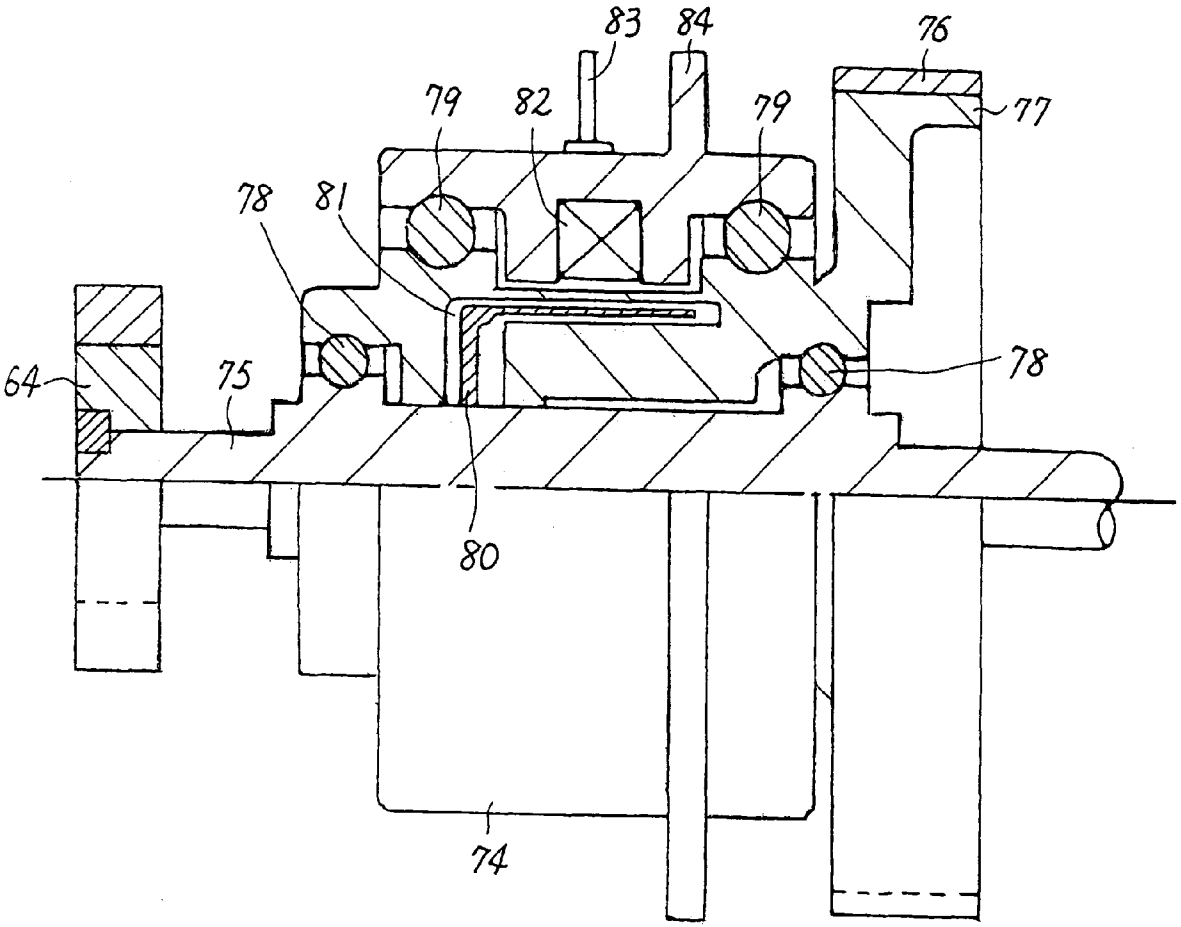
FIG. 17 is a half-sectional view illustrating a structure of a powder clutch.
Figure 18:
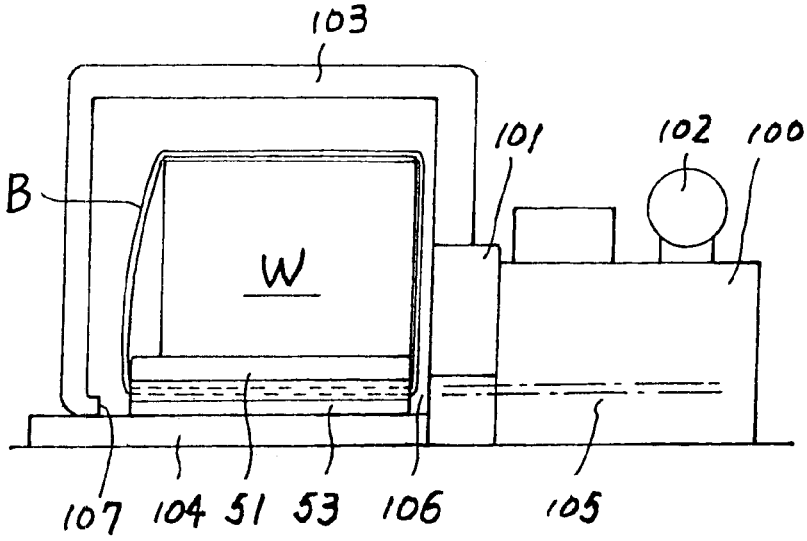
FIG. 18 PRIOR ART
FIG. 18 is a diagram illustrating a conventional baling machine.
Figure 19:
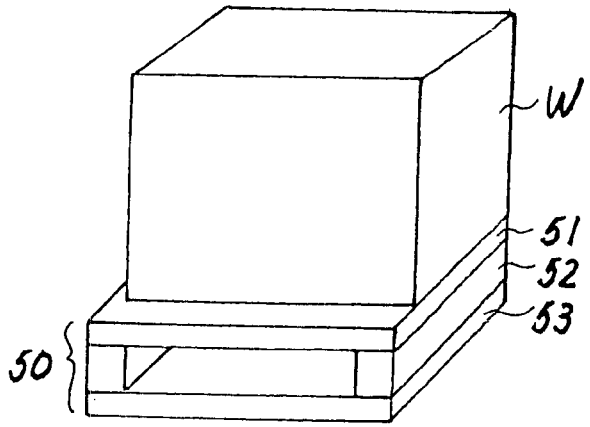
FIG. 19 is a diagram illustrating the state when an article is rested on a pallet.

As illustrated in the half sectional view of FIG. 17, a rotor 77 of the powder clutch 74 is coupled through a belt 76 to the output shaft of the motor 73. By coupling through the belt 76, the rotation of the output shaft of the motor 73 is transferred to the rotor 77. The tension roller 64 is coupled to a shaft 75 of the powder clutch 74. The rotor 77 supports the shaft 75 from outside through bearings 78. A base body 84 of the powder clutch 74 supports the rotor 77 from outside through bearings 79. Briefly, the shaft 75 and the rotor 77 are configured so as to be concentric.

The rotor 77 is an input member of the present invention and the shaft 75 is an output member of the present invention.

As illustrated in FIG. 17, a ring 80 is mounted on the shaft 75 and between the shaft 75 and the rotor 77, and the periphery of the ring 80 is covered with a magnetic powder material 81. The base body 84 is situated on the outer periphery of the magnetic powder material 81, and includes a coil 82. Upon the passage of an excitation current through a lead wire 83 connected to the coil 82, a magnetic field is generated around the coil 82. The magnetic powder material

81 bonds together firmly due to the generated magnetic field. The bonding of the magnetic powder material 81 causes fixation between the rotor 77 and the ring 80 mounted on the shaft 75.

As the excitation current passing through the coil 82 is increased, a force of the magnetic field generated around the coil 82 increases. As a force of the magnetic field increases, a strength of fixation between the shaft 75 and the rotor 77 increases to link the rotor 77 with the shaft 75, thus torque of the rotor 77 is transferred directly to the shaft 75. Briefly, as the excitation current passing through the coil 82 is increased, the torque transferred from the rotor 77 to the shaft 75 is increased.

On the other hand, as the excitation current passing through the coil 82 is decreased, a force of the magnetic field generated around the coil 82 decreases. As a force of the magnetic field decreases, a strength of the fixation between the rotor 77 and the shaft 75 decreases. This results in transferring only part of torque of the rotor 77 to the shaft 75. In other words, when the excitation current passing through the coil 82 is decreased, the rotor 77 and the shaft 75 are disengaged, resulting in a decrease in the torque transferred from the rotor 77 to the shaft 75.

In this way, it is possible to vary the excitation current passing through the coil 82 to change a strength of the fixation between the rotor 77 and the shaft 75 for controlling a magnitude of the torque transferred from the rotor 77 to the shaft 75. That is to say, the band tightening mechanism 60 can vary the torque transferred from the rotor 77 to the shaft 75 in accordance with the amount of excitation current passing through the coil 82 of the powder clutch 74, to control a force of tightening the band B.

Explanation of Codes

1 MAIN BODY
3 VERTICAL TABLE
7 BAND GUIDE
17 WHEELS
60 BAND TIGHTENING MECHANISM
64 TENSION ROLLER
73 MOTOR
74 POWDER CLUTCH
75 SHAFT (OUTPUT MEMBER)
77 ROTOR (INPUT MEMBER)

We claim:

1. A strapping packing machine comprising:

a main body including a band feeding mechanism, a band bonding mechanism, and a band cutting mechanism;

a vertical wall to be aligned with an article resting on a pallet;

a linear band guide having a first and a second opposed sides walls and a bottom wall connecting said first and second opposed sides, each of said side walls having a top surface, said band guide is drawn out from under said vertical wall in a horizontal direction;

a support mechanism for supporting said linear band guide inside said main body and allowing the linear band guide to slide, said support mechanism being structured and arranged so that it is placed substantially in abuttment with said first and second opposed sides walls, bottom wall and top surface to thereby support said linear band guide; and a plurality of wheels coupled to said main body.

2. The strapping packing machine according to claim 1, wherein said linear band guide is supported only by said support mechanism provided in said main body.

3. The strapping packing machine according to claim 1, wherein said support mechanism includes a retainer member for inhibiting the turning of a leading end of said linear band guide toward the ground contact of said wheels.

4. The strapping packing machine according to claim 1, wherein said support mechanism includes a stop mechanism for determining a selected position for drawing out said linear band guide.

5. The strapping packing machine according to claim 1, wherein said main body further includes a band tightening mechanism including an input member linked to an output shaft of a motor serving as a power source, an output member linked to a tension roller for pulling the band, and a powder clutch for engaging or disengaging said input member with or from said output member, and torque transferred from aid input member to said output member is varied in accordance with excitation current applied to said powder clutch.

* * * * *